US005186656A

United States Patent [19]

Harwath et al.

[11] Patent Number: 5,186,656

[45] Date of Patent: Feb. 16, 1993

[54] MINIATURE COAXIAL ELECTRICAL CONNECTOR

[75] Inventors: Frank A. Harwath, Downers Grove; Donald J. Brinkman, Woodridge; Glenn A. Landgraf, Naperville; Hasmukh Shah, Wheaton; Eric Stenstrom, Warrenville; David L. Brunker, Naperville, all of Ill.; Richard A. Johnson, Poughkeepsie, N.Y.

[73] Assignees: Molex Incorporated, Lisle, Ill.; International Business Machines Corporation, Armonk, N.Y.

[21] Appl. No.: 790,977

[22] Filed: Nov. 13, 1991

[51] Int. Cl.[5] ..... H01K 17/04

[52] U.S. Cl. ..... 439/585; 439/746

[58] Field of Search ..... 439/578-585, 439/675, 743-747

[56] References Cited

U.S. PATENT DOCUMENTS

| | | | |
|---|---|---|---|
| 3,302,159 | 1/1967 | Schumacher | 439/675 |
| 3,539,976 | 11/1970 | Reynolds | 439/585 |
| 3,660,805 | 5/1972 | McDonough | 439/585 |
| 4,033,662 | 7/1977 | Swiger | 439/675 |
| 4,269,469 | 5/1981 | Audic | 439/585 |
| 4,406,512 | 9/1983 | Schell | 339/177 R |
| 4,602,830 | 7/1986 | Lockard | 339/14 R |
| 4,624,525 | 11/1986 | Ichimura et al. | 439/585 |
| 4,650,271 | 3/1987 | Forney, Jr. et al. | 439/874 |
| 4,889,500 | 12/1989 | Lazar et al. | 439/579 |
| 4,897,046 | 1/1990 | Tengler et al. | 439/579 |
| 4,941,833 | 7/1990 | Noschese et al. | 439/92 |
| 4,964,814 | 10/1990 | Tengler et al. | 439/607 |
| 5,055,068 | 10/1991 | Machura et al. | 439/581 |
| 5,060,373 | 10/1991 | Machura et al. | 29/858 |
| 5,066,249 | 11/1991 | Doye et al. | 439/585 |

OTHER PUBLICATIONS

Research Disclosure, Apr. 1991, 32446.

*Primary Examiner*—David L. Pirlot
*Attorney, Agent, or Firm*—Charles S. Cohen

[57] ABSTRACT

In the exemplary embodiment of the invention, the miniature coaxial contact terminates a coaxial cable which includes a signal wire, an insulating jacket surrounding the signal wire, ground means surrounding the insulating jacket and an outer insulating sheath surrounding the ground means. The contact includes a signal pin having a contact end for mating with an appropriate receptacle contact and a terminating end having a coined portion for termination to the signal wire. Insulator means is provided about at least a portion of the signal pin. A grounding shield tube is provided about the insulator means. The tube has an inner surface for termination to the ground means of the cable.

20 Claims, 3 Drawing Sheets

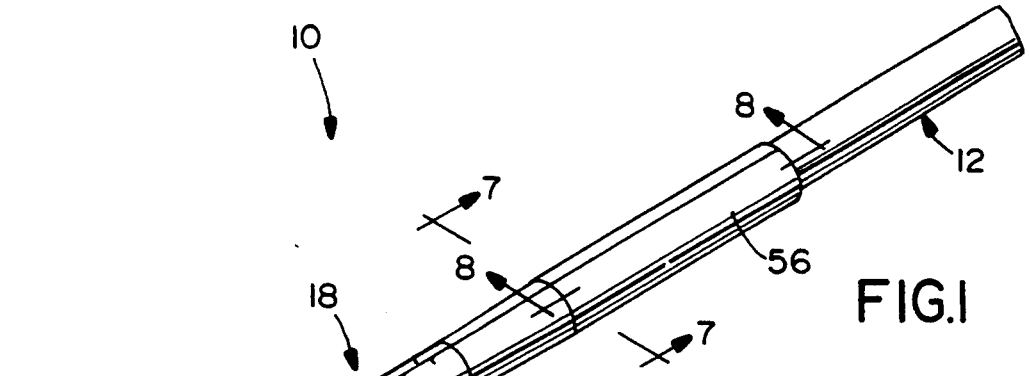
FIG.1
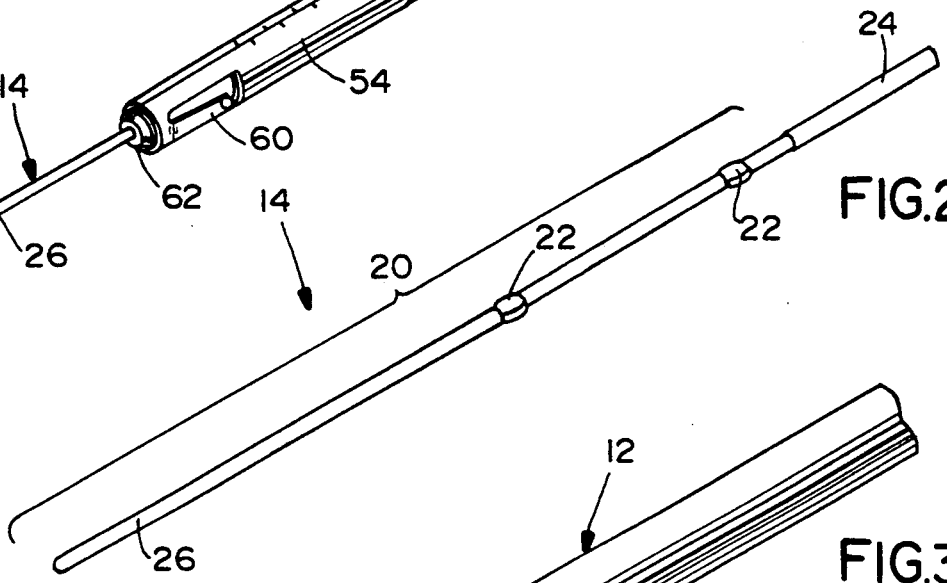
FIG.2
FIG.3
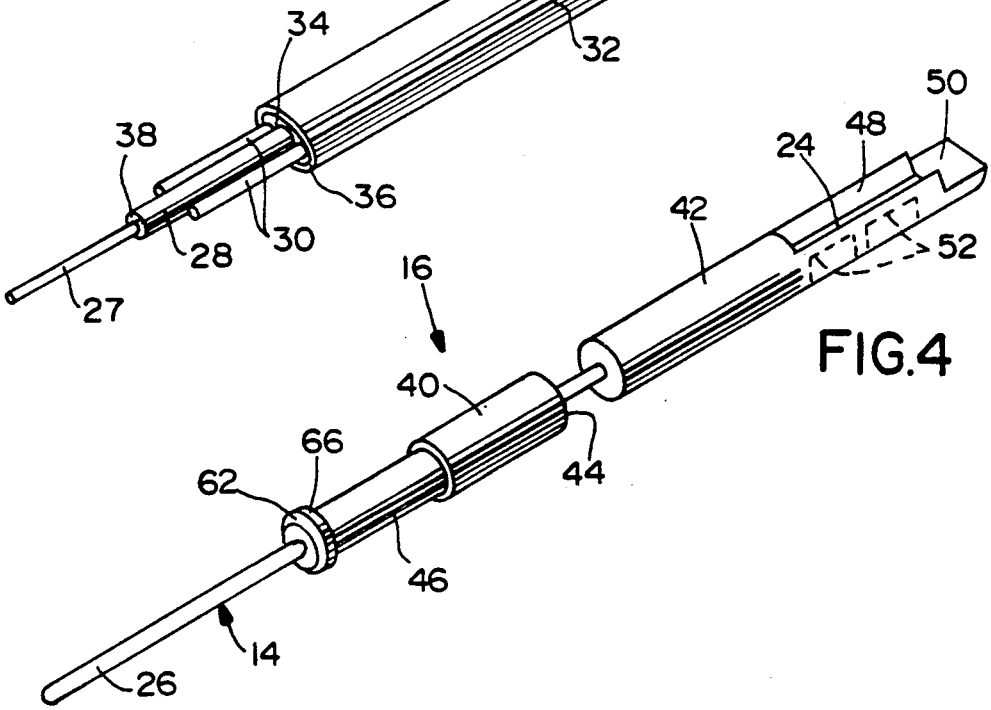
FIG.4

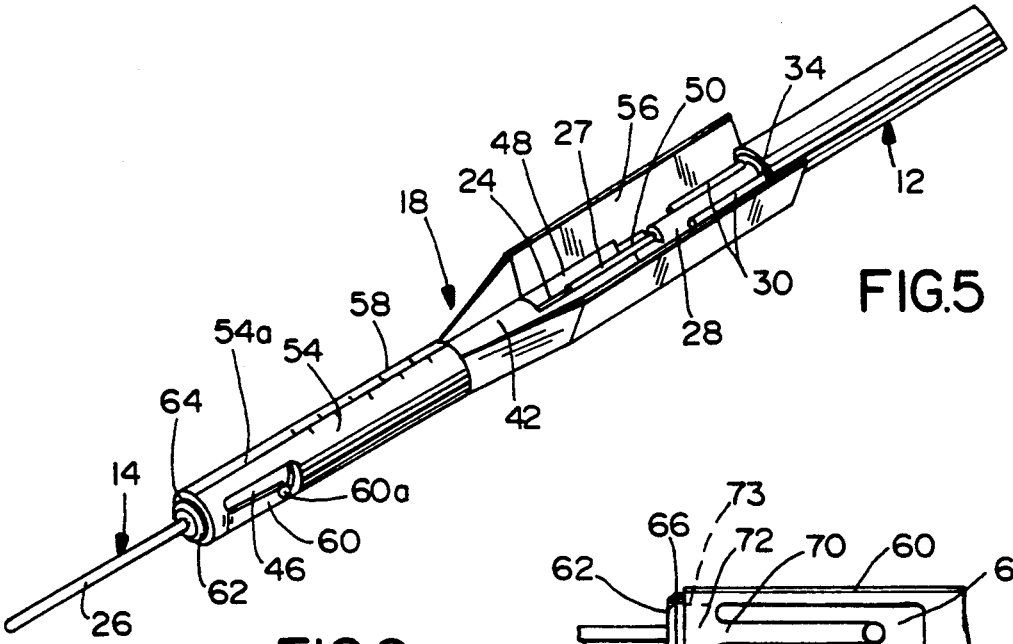
FIG.5
FIG.6
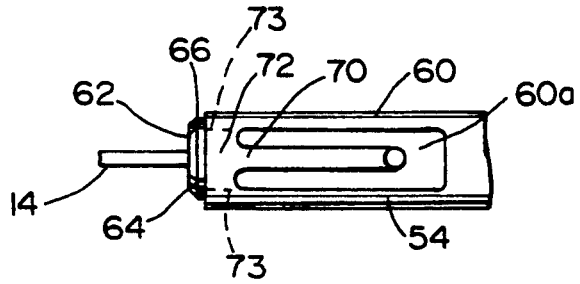
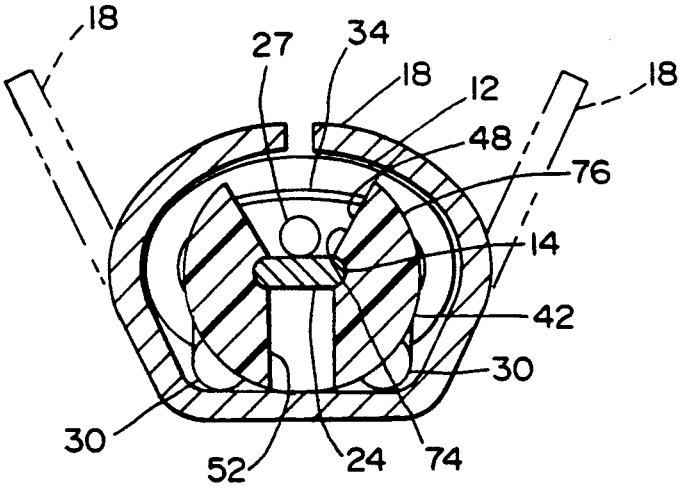
FIG.7
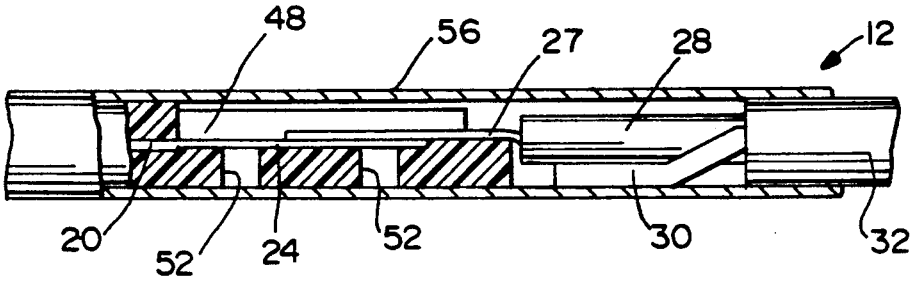
FIG.8

MINIATURE COAXIAL ELECTRICAL CONNECTOR

FIELD OF THE INVENTION

This invention generally relates to the art of electrical connectors and, more particularly, to a miniature coaxial connector terminated to a coaxial cable.

BACKGROUND OF THE INVENTION

As the operating speed of electronic components increases and as the size of the components decreases, it becomes increasingly difficult to design and manufacture electrical connectors that do not restrict system performance, and are not prohibitively expensive. This is particularly true in computer system applications wherein coaxial cables are used for high speed data transmission.

In such applications, the size of the electrical connector is critically important as computer manufacturers and users strive for smaller machines. Of equal importance for very high speed computers is the performance of the electrical connectors. A coaxial cable has a relatively uniform, predetermined impedance throughout its length and it is desirable that any electrical connections maintain and match this impedance in order to minimize the degradation of signals propagating through the system.

Electrical connectors of the prior art were deficient in one or more of these areas in that they were generally large and expensive, or lacking in electrical performance. Typically, if a system designer needed high electrical performance he/she had to resort to using connectors which have been designed solely for use in the communication industry. These connectors, while performing well, often occupy as much as 0.5 square inches of printed wiring board per signal terminal. In addition, the cost of these connectors is on the order of 100 times the cost, per line, of the connectors usually found in computer systems. However, this has generally been the only option because the connectors generally in use in computer systems are deficient in electrical performance in that they limit total system performance to an unacceptably low level.

SUMMARY OF THE INVENTION

An object, therefore, of the invention is to provide a new and improved, miniature coaxial contact terminated to a coaxial cable.

In the exemplary embodiment of the invention, the miniature coaxial contact terminates a coaxial cable which includes a signal wire, an insulating jacket surrounding the signal wire, ground means surrounding the insulating jacket and an outer insulating sheath surrounding the ground means. The contact includes a signal pin having a contact end for mating with an appropriate receptacle contact and a terminating end having a coined portion for termination to the signal wire. Insulator means is provided about at least a portion of the signal pin. A grounding shield tube is provided about the insulator means. The tube has an inner surface for termination to the ground means of the cable.

The coaxial contact provides a substantially controlled impedance (typically at the impedance of the terminated cable) about its length. The contact also reduces crosstalk due to its substantially shielded configuration.

As disclosed herein, the grounding shield is provided in the form of a ground tube member that surrounds and shields the termination of the signal wire to the signal pin. The ground means of the coaxial cable is an outer conductive shield with a drain wire or wires, and the ground wire is bonded to the ground tube.

The invention also contemplates that the signal pin has a substantially uniform cross-section along a substantial portion of its length. The cross-section of that portion has an interruption at a given location for retaining an overmolded insulator thereon. In the preferred embodiment, the substantial portion of the pin is generally round in cross-section and the interruption is provided by a flattened area of the round pin portion.

The signal pin has a contact end for mating with an appropriate receptacle contact and a terminating end for termination to the signal wire. In order to facilitate overmolding the insulator on the pin, the insulator includes a gap exposing a length of the pin intermediate its ends to provide access means through which the pin can be supported during the overmolding process. Therefore, the pin can be supported at least at three points along its length, i.e., at its contact end, its terminating end and in the gap of the insulator.

In order to support the signal pin at its terminating end, the insulator includes opposed access openings on a side thereof. One of these openings also provides means for terminating the signal wire to the signal pin in a direction transversely of the pin. As disclosed herein, that opening is provided in the form of a trough extending longitudinally of the pin. The trough has an open bottom exposing the terminating end of the signal pin for supporting the pin during the overmolding process as well as for terminating the pin to the signal wire through the trough. Preferably, the sides of the trough diverge from the open bottom thereof for guiding the signal wire into the trough.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 1 is a perspective view of a coaxial contact embodying the concepts of the invention;

FIG. 2 is a perspective view of a signal pin contained within the contact of FIG. 1;

FIG. 3 is a view of a tri-lead coaxial cable, with the various components thereof prepared for termination to the signal pin of FIG. 2;

FIG. 4 is a perspective view of the signal pin overmolded with its insulating means;

FIG. 5 is a perspective view of the signal pin assembly of FIG. 4 and the prepared coaxial cable of FIG. 3 terminated within a shield, with the shield in its open position;

FIG. 6 is an enlarged, fragmented elevational view of a portion of the tubular forward portion of the shield including one of the spring fingers thereof;

FIG. 7 is a vertical section taken generally along line 7—7 of FIG. 1;

FIG. 8 is a fragmented vertical section taken generally along line 8—8 of FIG. 1.

DETAILED DESCRIPTION OF THE PREFERRED EMBODIMENT

Figure 9:
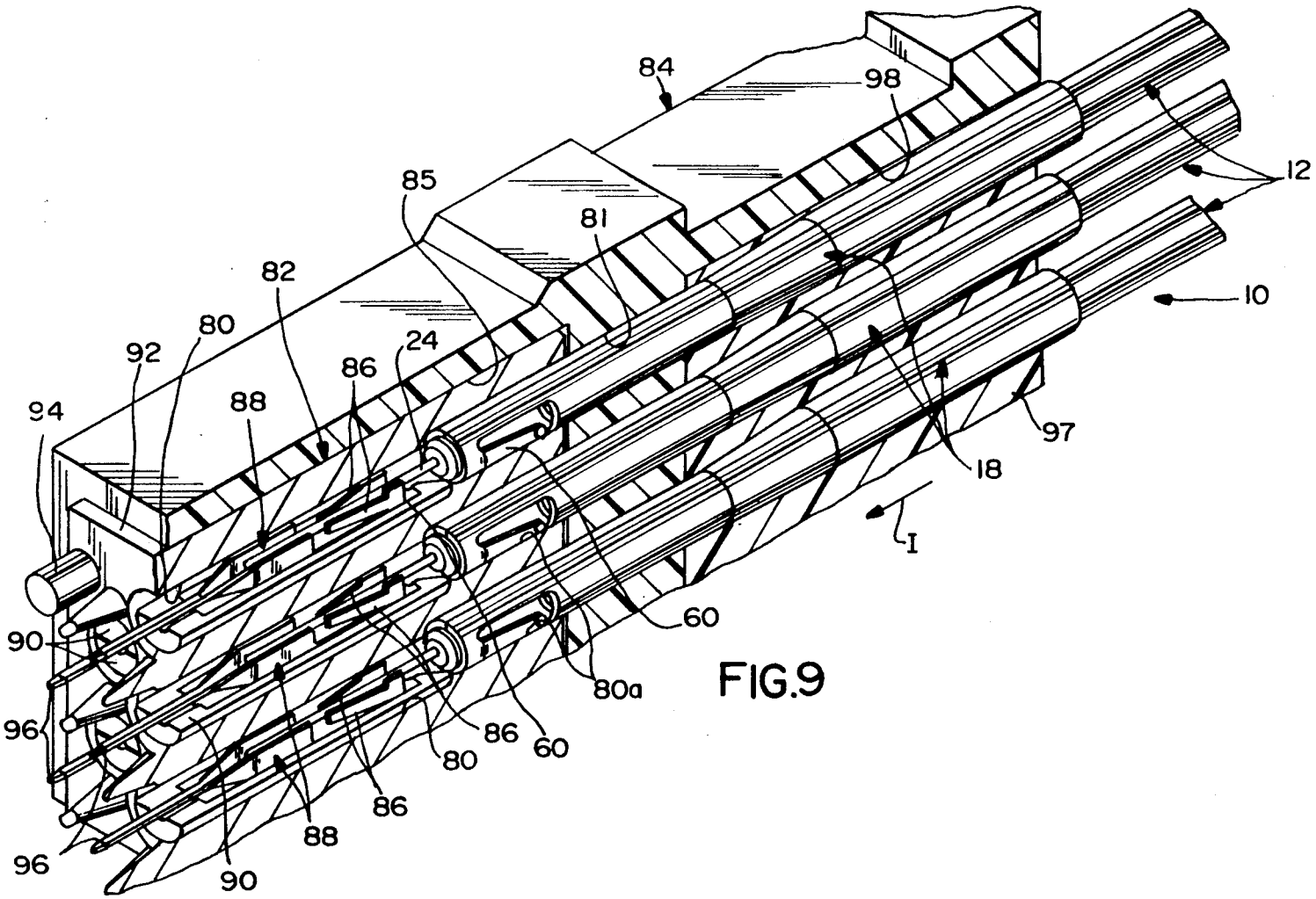
FIG. 9 is a perspective view of three of the coaxial connector assemblies of FIG. 1 inserted and terminated in a mating receptacle which is shown in section.

Referring first to FIG. 1, a miniature coaxial contact, generally designated 10, embodying the present invention is shown as being terminated to a tri-lead coaxial cable, generally designated 12. The contact 10 is designed to mate with female terminals 88 and grounding housing 92 (FIG. 9). Each of these is described more completely in co-pending Ser. Nos. 07/791,867 and 07/791,866 now U.S. Pat. Nos. 5,167,544 and 5,162,001 each of which are incorporated by reference herein. The coaxial contact 10 includes a signal pin contact, generally designated 14, an overmolded insulator assembly, generally designated 16 (FIG. 4), and a tubular ground shield structure, generally designated 18.

As shown in FIG. 2, pin contact or signal pin 14 has a substantially uniform cross-section along a major or substantial portion 20 of its length. In the preferred embodiment, the cross-section of the pin along its major length is round. The pin also has a pair of spaced interruptions 22 which, in the illustrated embodiment, are provided in the form of flattened areas of the otherwise round configuration of the pin. The pin also has a flattened terminating end 24 opposite its distal or contact end 26. The terminating end 24 is flattened by a coining operation to provide a greater target area for bonding a signal wire 27 (FIG. 3) thereto, such as by brazing or welding as described hereinafter. Other configurations could be coined if desired such as a convex surface to maximize the contact pressure during the bonding operation or a concave surface to retain solder.

FIG. 3 shows the general construction of the tri-lead coaxial cable 12 as well as its configuration immediately prior to termination to contact 10. The cable 12 includes a signal wire or core 27 surrounded by an insulating jacket 28. A pair of ground wires 30 run lengthwise of the coaxial cable adjacent insulating jacket 28 and inside an outer dielectric sheath 32 of the cable 12. A conductive shield 34 is located inside outer dielectric sheath 32 and contacts ground wires 30. The outer dielectric sheath 32 and conductive shield 34 are cut-away, as at 36, to expose lengths of the ground wires 30, and insulating jacket 28 is cut-away, as at 38, to expose a length of signal wire 27. It can be seen that the signal wire and ground wires of the cable is "differentially stripped". In other words, insulating jacket 28 is stripped a given distance from the end of signal wire 27 so that the insulating jacket 28 extends a predetermined distance from the edge 36 of cable 12. Ground wires 30 are cut-off at a length that is shorter than the length of exposed insulating jacket 28. This prevents shorting between the signal wire 27 and the ground wires 30.

Referring to FIG. 4 in conjunction with FIG. 2, insulator 16 is shown overmolded about pin contact 14 rearwardly of contact end 26 and beyond terminating end 24. More particularly, a pair of insulator sections 40 and 42 define a gap 44 therebetween. The insulator sections are overmolded onto pin contact 14 in a correspondingly shaped mold, and of dielectric material such as plastic or the like. Forward insulator section 40 has a reduced diameter or relieved portion 46 for purposes described hereinafter.

Rear insulator section 42 has a trough 48 extending lengthwise of the insulator section (i.e., axially of the signal pin) along a portion thereof whereby the trough provides access to the top of terminating end 24 of signal pin 14. The inner walls 74 of the trough diverge from the bottom thereof, as shown in FIGS. 4 and 7, for purposes described hereinafter. The distal end of insulator section 42 has a flat surface 50 also for purposes described hereinafter. Insulator section 42 also has a pair of recesses 52 (FIGS. 4 and 7) through the underside thereof opposite trough 48. The recesses 52 extend through the bottom of insulator section 42 to provide access to the bottom of terminating end 24 of pin 14. A pair of recesses 52 is provided so that the plastic between the recesses adequately supports the pin 14 while the signal wire 27 is bonded thereto.

It is desirable to be able to support pin 14 on opposite sides during overmolding. This can be done at the contact end 26 of the pin, in the gap 44 between insulator sections 40 and 42, and on the opposite sides of flat terminating end 24 that are exposed by trough 48 and recesses 52. By supporting pin 14 in such a manner, flash can be virtually eliminated from extending onto contact end 26 and terminating end 24. In addition, supporting the pin at three locations also helps to maintain the linearity of the pin.

It should be noted that in comparing FIGS. 2 and 4, flattened interruptions 22 on signal pin 14 are not visible in FIG. 4. These interruptions are located within the overmolded sections 40 and 42 in order to better retain the plastic material of the overmolded sections on the pin. Overmolding the insulator sections is preferred, versus simply sliding the sections onto the signal pin, to provide better securement of the sections on the pins, particularly in combination with interruptions 22. In addition, overmolding reduces the need for handling very small components such as insulators.

Referring to FIG. 5 in conjunction with FIGS. 3 and 4, the stamped and formed ground tube or shield 18 is shown in FIG. 5 with the termination area adjacent the signal pin 14 and the signal wire 27 exposed. More particularly, shield 18 includes a tubular forward portion 54 surrounding forward insulator section 40 (FIG. 4) and a channel-shaped section 56 housing rear insulator section 42, the prepared end of coaxial cable 12 as illustrated in FIG. 3, and a portion of the unprepared cable 12 located therein.

The tubular forward portion 54 is split, as at 54*a*, lengthwise thereof, and the tubular portion is crimped onto forward insulator section 40 to retain the overmolded pin assembly therein. The metal of the tubular portion is corrugated in a "sawtoothed" fashion along split 54*a*, as at 58. After the crimping operation, the corrugations assist in retaining the overmolded pin assembly therein without substantial deformation of insulator section 40 which could change the impedance of the connector 10.

Forward tubular portion 54 of the shield includes a pair (only one being visible in FIG. 5) of spring fingers 60 which are provided on opposite sides of the shield for engaging a portion of bore 80 of a complementary connector 82 (FIG. 9). Therefore, as described in relation to FIG. 4, reduced diameter portion 46 of insulator section 40 is provided for accommodating movement of the spring fingers 60 radially inwardly during insertion of the coaxial connector 10 into bore 80*a* (FIG. 9). Each spring finger 60 has an outwardly convex or hemispherical distal contact end 60*a*. This configuration reduces the contact area which produces a high contact pressure for a given biasing force. This high contact pressure increases the reliability of the contact.

FIG. 6 shows the detail of the front edge of the ground tube 18 and insulator 16 as well as one of the spring fingers 60. It can be seen that the spring finger is integrally formed with the tubular portion 54 of the shield 18 and extends rearwardly therefrom in cantilever fashion. The widened root portion 70 of the spring finger and the circumferential band 72 of metal between spring finger 60 and the front edge 64 of ground tube 18 (between dotted lines 73 in FIG. 6) are dimensioned so that band 72 twists as spring finger 60 is deflected. Thus, the effective spring rate is equal to the combination of that of the spring fingers 60 plus the torsional effect of band 70. Consequently, the spring finger 60 can be made shorter yet still provide the desired contact force at its distal end 60*a*.

Referring back to FIG. 5, the tapered forward end 62 of forward insulator section 40 projects beyond the forward end 64 of the tubular forward portion 54 of shield 18. The forward end 64 of the tubular portion 54 is crimped into reduced diameter portion 46 of the insulator section 40 behind the front shoulder 66 of the reduced diameter portion. Therefore, when the shielded assembly is inserted into bore 80, the tapered forward edge 62 of the insulator 16 acts as a lead-in to prevent the forward end 64 of the tubular portion from stubbing against the entry of the bore.

FIG. 5 also shows signal wire 27 of coaxial cable 12 positioned to rest on top of terminating end 24 of signal pin 14. The signal wire 27 is placed into trough 48, with the diverging inner walls 74 of the trough guiding the signal wire onto the terminating end 24 of the signal pin. The outer side walls 76 of rear insulator section 42 reduce the likelihood that rear portion 56 will contact either the signal pin 14 or signal wire 27 once the rear portion is closed as shown in FIG. 1. That is, if rear portion 56 is deformed while being closed so that it would touch either signal pin 14 or signal wire 27, the side walls will be deformed by rear portion 56 and thus insulate the signal pin and signal wire. The signal wire 27 rests on top of flat surface 50 of insulator section 42. The signal wire 27 then can be bonded such as by brazing to the flattened terminating end 24 of the signal pin 14.

As further seen in FIGS. 1, 5 and 8, rearward section 56 of shield 18 overlaps cable shield 34 to fully shield the termination and prevent RF emissions. By maintaining the geometrical relationship between the signal pin and the shield and by selecting an insulator having a desired dielectric constant, a controlled impedance coaxial contact is realized.

Referring to FIGS. 7 and 8, the position of signal wire 27 and ground wires 30 with respect to signal pin 14 and ground tube 18 is shown more clearly. It can be seen that ground wires 30 have been bent downwardly into engagement with the bottom of the inside of rear portion 56 of shield 18. The ground wires 30 are bonded to the shield 18 prior to closing rear portion 56. This can be accomplished by brazing, welding or soldering as discussed below. As shown in FIG. 7, the bottom of rearward portion 56 of shield 18 is flattened to provide a planar surface to facilitate bonding of ground wires 30 thereto. FIG. 7 also shows how signal wire 27 rests on top of the flattened terminating end 24 of signal pin 14.

To manufacture the coaxial contact 10 of the present invention, the signal pin 14 is first formed to the desired shape as shown in FIG. 2. The insulator 16 is then overmolded around the signal pin 14. The ground tube 18 is stamped and formed so that the front portion 54 is generally tube shaped and dimensioned slightly larger than insulator portion 40. The rear portion 56 is shaped in an open configuration (FIG. 5) to permit access to the termination portion 24 of signal pin 14 and the inner portion of ground tube 18 for terminating the signal wire 27 and drain wires 30 thereto, respectively.

The front portion 54 of the ground tube is formed about the front insulator portion 40 to retain the insulator 16 and signal pin 14 thereto. The drain wires 30 are brazed to the rear portion 56 of the ground tube and the signal wire 27 is brazed to signal pin 14. The rear portion 56 of ground tube 18 is deformed to close ground tube 18 in a generally cylindrical shape.

The respective wires are joined to the signal pin 14 and ground shield 18 by a combination of heat and pressure which actually effect a braze due to the presence of plated coatings on the components. Specifically, pin 14 and shield 18 are nickel plated at least in the brazing areas, and signal wire 27 and ground wires 30 are of silver or silver plated material. Joining the wires to the respective portions of the signal pin and ground tube in this manner reduces the overall lateral cross-sectional area of the termination when compared to termination methods such as crimping or insulation displacement. It is contemplated that other means for terminating the drain wires and the signal wire, such as soldering, ultrasonic welding, thermo-compression welding, resistance welding or the like, could be utilized.

Referring to FIG. 9, a portion of a connector housing three of the coaxial contacts 10 is shown with the contacts mounted in bores 81 in an insulative housing, generally designated 84, at one end of a cable harness. A connector of this type would typically be terminated at each end of the cable harness. The housing has a receptacle cavity 85 for receiving a mating connector 82. The contact ends 24 of the pins 14 make contact with pairs of cantilevered arms 86 of a plurality of female electrical terminals, generally designated 88. Each female terminal is disposed in a pair of insulators 90 which, in turn, is mounted in a respective bore 80 of a conductor grounding connector housing 92. The housing is designed for mounting to a printed circuit board (not shown), with stand-offs 94 spacing the housing from the printed circuit board. It can be seen that female terminals 88 have solder tail portions 96 for insertion into holes in an appropriate printed circuit board for connection to appropriate circuit traces around or within the holes in the board. After the individual coaxial contacts are inserted into insulative housing 84, they are further secured therein by pouring an epoxy filler 97 into the rear cavity 98.

Upon insertion of coaxial contacts 10 into reduced-diameter portions 80*a* of bores 80 from the right-hand end of receptacle assembly 82, in the direction of arrow "I", contact ends 24 spread cantilevered arms 86 of female terminals 88. When the coaxial contacts are fully inserted, spring fingers 60 of grounding shield 18 engage flat surfaces of grounding housing 92 within reduced diameter bore portions 80*a*. With the ground wires 30 of coaxial cable 12 grounded to shield 18, as described above, the ground wires are grounded through shield 18 and spring fingers 60 to housing 92.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A coaxial contact for termination to a coaxial cable, said cable including a signal wire surrounded by an inner insulating member, ground means surrounding said inner insulating member an outer insulating sheath surrounding said ground means, said coaxial contact comprising:

a male signal pin formed of a solid cylindrical rod throughout substantially its entirety and including a contact end for mating with an appropriate female receptacle contact and a terminating end for termination to said signal wire, said terminating end having a coined portion acting as a bonding site for said signal wire;

insulation means surrounding a portion of said signal pin including said terminating end; and a generally cylindrical, one piece, stamped and formed ground shield tube positioned about said insulation means, said ground shield tube having an inner surface for termination to said ground means of said coaxial cable, said terminating end of said signal pin being located within said ground shield tube and said ground shield tube further including a leading edge, a rear portion and a front portion therebetween, said front portion including at least one spring contact arm extending in cantilever fashion away from said leading edge for contacting a conductive surface of a bore into which said contact is inserted when mated with a mating connector; and said insulation means further includes recess means radially inward from said at least one contact arm to prevent restriction of movement of said contact arm.

2. The coaxial contact of claim 1 wherein the portion of said ground shield tube between said contact arm and said leading edge is dimensioned so as to twist during deflection of said contact arm.

3. The coaxial contact of claim 1 wherein a portion of said ground shield tube is secured to said insulation means and said portion includes a seam having a plurality of circumferentially directed, sawtoothed serrations along each side of the seam, said serrations having relatively sharp edges that extend into said insulation means to grip said insulation means without substantial deformation of the insulation means and a resultant substantial change in impedance of the connector.

4. The coaxial contact of claim 1 wherein said solid cylindrical rod includes an interruption at a predetermined location for retaining an overmolded insulator on said signal pin.

5. The coaxial contact of claim 1 wherein said recess means includes a region of reduce diameter.

6. The coaxial contact of claim 1 wherein said insulation means includes a front insulation member and a rear insulation member, and said front and rear insulation members are generally cylindrically shaped.

7. The coaxial contact of claim 6 wherein said front and rear insulation members are spaced apart longitudinally along said signal pin.

8. The coaxial contact of claim 6 wherein an end of the front insulation member closest to said contact end of said signal pin is tapered.

9. The coaxial contact of claim 6 wherein said rear insulation member includes access means therein to permit access to said coined portion of said signal pin, said coined portion of said terminating portion is generally flat and whereby said signal wire can be bonded electrically and mechanically to said coined portion through said access means without any other securement means.

10. The coaxial contact of claim 9 wherein said access means comprises a trough in said rear insulation member, said trough extending longitudinally of said signal pin and having an open bottom exposing the coined portion of said signal pin.

11. The coaxial contact of claim 10 wherein sides of said trough diverge from the open bottom thereof for guiding the signal wire towards the coined portion of the signal pin as the signal wire moves toward said bottom.

12. The coaxial contact of claim 10 wherein sides of said trough are dimensioned to reduce the likelihood that a portion of said ground shield tube will contact the signal pin after said tube is closed around said rear insulation member.

13. The coaxial contact of claim 10 wherein said rear insulation member includes support access means opposite said trough for providing access to the side of said coined portion of said signal pin opposite said trough.

14. A miniature coaxial contact for termination to a coaxial cable, said cable including a signal wire surrounded by an inner insulating member, ground means surrounding said inner insulating member and an outer insulating sheath surrounding said ground means, said coaxial contact comprising:

a generally straight male signal pin formed of a solid cylindrical rod throughout substantially its entirety and including a contact end for mating with an appropriate female receptacle contact and a terminating end for termination to said signal wire;

insulation means surrounding a portion of said signal pin including said terminating end; and a ground shield member positioned about said insulation means, said ground shield tube having an termination region at which said signal pin is terminated to said signal wire and said ground means of said coaxial cable is terminated to an inner surface of said ground shield member, said termination region including closure means movable from a first position, at which said inner surface and said terminating end of said signal pin are accessible for termination, to a second position, at which said ground shield member is tube shaped and said inner surface and said terminating end of said signal pin are inaccessible for termination, said ground shield member further including a portion secured to said insulation means with said portion including a seam having a plurality of circumferentially directed, sawtoothed serrations along each side of the seam, said serrations having relatively sharp edges that extend into said insulation means to grip said insulation means without substantial deformation of the insulation means and a resultant substantial change in impedance of the connector.

15. The miniature coaxial contact of claim 14 wherein said ground means of said coaxial cable includes a ground shield and a drain wire, and said drain wire is securely fixed electrically and mechanically to said inner surface of said ground shield tube by bonding with heat and pressure.

16. The miniature coaxial contact of claim 15 wherein said insulation means includes access means therein to permit access to said terminating end of said signal pin whereby said signal wire can be bonded to said terminating end through said access means.

17. The miniature coaxial contact of claim 16 wherein said access means comprises a trough in a rear portion of said insulation means, said trough extending longitudinally of said signal pin and having an open bottom exposing the terminating end of said signal pin and wherein sides of said trough diverge from the open bottom thereof for guiding the signal wire towards the terminating end of the signal pin as the signal wire moves toward said bottom.

18. A miniature coaxial contact and coaxial cable assembly comprising:

a coaxial cable including a signal wire surrounded by an inner insulating member, ground means surrounding said inner insulating member, said ground means including at least one drain wire electrically connected to a cable ground shield, and an outer insulating sheath surrounding said ground means;

a coaxial contact including a male signal pin, insulation means and a generally cylindrical ground shield tube;

said signal pin formed of a solid cylindrical rod throughout substantially its entirety and including a contact end for mating with an appropriate female receptacle contact and a terminating end terminated to said signal wire;

said insulation means surrounding a portion of said signal pin including said terminating end; and said ground shield tube including front and rear sections, said front section being positioned about a portion of said insulation means, said rear section having an inner surface to which said ground means of said coaxial cable is terminated, said rear section being deformable from a first position, at which said inner surface and said terminating end of said signal pin are accessible for termination, to a second position, at which said inner surface and said terminating end of said signal pin are inaccessible for termination, said ground shield tube being generally cylindrical when said rear section is positioned at said second position, said ground shield tube further including at least one spring contact arm extending in cantilever fashion away from a leading edge of said tube for contacting a conductive surface of a bore into which said contact is inserted when mated with a mating connector, the portion of said ground shield tube between said contact arm and said leading edge being dimensioned so as to twist during deflection of said contact arm.

19. The miniature coaxial contact of claim 18 wherein said front section includes a seam having a plurality of circumferentially directed, sawtoothed serrations along each side of the seam, said serrations having relatively sharp edges that extend into said insulation means to grip said insulation means without substantial deformation of the insulation means and a resultant substantial change in impedance of the connector.

20. The miniature coaxial contact and coaxial cable assembly of claim 18 wherein said ground means of said coaxial cable includes a conductive shield and at least one drain wire, said drain wire being securely fixed electrically and mechanically to said inner surface of said ground shield tube by bonding with heat and pressure.

* * * * *